US011383122B1

(12) United States Patent
Davis

(10) Patent No.: US 11,383,122 B1
(45) Date of Patent: Jul. 12, 2022

(54) PORTABLE EXERCISE KIT

(71) Applicant: Walter Davis, Sevierville, TN (US)

(72) Inventor: Walter Davis, Sevierville, TN (US)

( * ) Notice: Subject to any disclaimer, the term of this patent is extended or adjusted under 35 U.S.C. 154(b) by 0 days.

(21) Appl. No.: 16/898,619

(22) Filed: Jun. 11, 2020

Related U.S. Application Data

(60) Provisional application No. 62/859,829, filed on Jun. 11, 2019.

(51) Int. Cl.
*A63B 21/00* (2006.01)
*A63B 21/04* (2006.01)
*A63B 21/055* (2006.01)

(52) U.S. Cl.
CPC ..... *A63B 21/4029* (2015.10); *A63B 21/0442* (2013.01); *A63B 21/0557* (2013.01); *A63B 2210/50* (2013.01); *A63B 2225/09* (2013.01)

(58) Field of Classification Search
CPC . A63B 21/4029; A63B 2210/50; A63B 21/02; A63B 2210/54; A63B 21/021; A63B 21/022; A63B 21/023; A63B 21/025; A63B 21/026; A63B 21/027; A63B 21/028; A63B 21/04; A63B 21/0407; A63B 21/0442; A63B 21/0557; A63B 2225/09; A47B 3/083; A47B 5/00; A47B 3/00; A47B 1/00; A61G 13/105
See application file for complete search history.

(56) References Cited

U.S. PATENT DOCUMENTS 377,806 A * 2/1888 Graves ..... A47C 13/00 297/119
1,320,365 A * 10/1919 Clough ..... A47C 1/143 297/19
2,517,681 A * 8/1950 Koerper ..... A61G 13/105 606/242
2,845,112 A * 7/1958 Borenstein ..... A47C 17/12 297/118
6,500,104 B1 * 12/2002 Rich ..... A63B 21/04 482/123
7,229,392 B2 6/2007 Turnbull et al.
8,162,809 B1 4/2012 Eastwood
(Continued)

FOREIGN PATENT DOCUMENTS

EP 3692970 A1 * 8/2020 ..... A61G 13/009
FR 407526 A * 3/1910 ..... A61G 13/105
GB 557275 A * 11/1943 ..... A61G 13/105

*Primary Examiner* — Andrew S Lo
*Assistant Examiner* — Andrew M Kobylarz
(74) *Attorney, Agent, or Firm* — Boudwin Intellectual Property; Daniel Boudwin

(57) ABSTRACT

A portable exercise kit. The kit includes a bench that is comprised of a plurality of sections which are hingedly connected together. Each section includes a frame portion, cross members, and legs hingedly connected thereto. The bench further includes eyelets that extend outwardly from the frame portions of the sections. The sections and legs collapse together and expand apart to move the bench between a storage configuration and an expanded configuration. The kit further includes padded members, elastic members, and handles which enable an individual to manipulate the elastic members. The elastic members can be affixed to the eyelets as desired to provide various levels of resistance exercise and aid a user in performing stretching maneuvers.

17 Claims, 6 Drawing Sheets

(56) References Cited

U.S. PATENT DOCUMENTS

| | | | | |
|---|---|---|---|---|
| 8,276,984 | B1 * | 10/2012 | Jamison, Jr. | A47C 17/14<br>297/126 |
| 8,794,699 | B1 * | 8/2014 | Rudolfo | A47C 17/16<br>297/184.15 |
| 9,901,502 | B2 * | 2/2018 | Rosario, Jr | A63B 23/03541 |
| 2009/0131230 | A1 | 5/2009 | Cole | |
| 2010/0016134 | A1 * | 1/2010 | Reese | A63B 21/0552<br>482/131 |
| 2014/0190371 | A1 * | 7/2014 | Woog | A61G 13/105<br>108/36 |
| 2016/0354629 | A1 | 12/2016 | Salamon et al. | |

* cited by examiner

PORTABLE EXERCISE KIT

CROSS REFERENCE TO RELATED APPLICATIONS

This application claims priority under 35 U.S.C. § 119(e) to U.S. Provisional Application No. 62/859,829 filed on Jun. 11, 2019. The above identified patent application is incorporated by reference herein in its entirety to provide continuity of disclosure.

BACKGROUND OF THE INVENTION

The present invention relates to a foldable and collapsible portable exercise kit that enables individuals to transport and deploy the kit in situations and spaces that ordinarily do not lend themselves to exercising.

Many individuals are regularly engaged with occupations or activities that leave little time and space for physical activity. For example, individuals operating motor vehicles for long periods of time do not have ready access to exercise space inside their vehicles. Long-distance truck drivers, in particular, tend to be more susceptible to injuries or other health problems as a result of such lack of physical exercise and activity. Even during their free time, many of these truck drivers are often unable to exercise as they have very little vehicle storage space for their personal articles such as gym and exercise equipment.

Therefore, there is a need in the art for a portable exercise kit that allows stationary individuals, particularly those with limited available storage space, to exercise as needed to maintain or improve their health. The present invention addresses this unmet need.

Kits and devices have been disclosed in the art that relate to exercise. These include items that have been patented and published in patent application publications. These items are often bulky, heavy, and do not provide a sufficiently compact structure to enable users to perform a variety of exercises and muscle stretches. In view of the items disclosed in the art, it is submitted that there is a need for an improvement to existing kits, devices, and other items that relate to exercise and that the present invention substantially diverges in structural and functional elements from these items in the art, and substantially fulfills an unmet need.

SUMMARY OF THE INVENTION

In view of the disadvantages inherent in the known types of exercise equipment in the art, the present invention provides an exercise kit, wherein the same can be utilized for enabling individuals to compactly store the kit as well as deploy the same in order to exercise, stretch, and perform other similar physical activities while on the go.

It is therefore an object of the present invention to provide a portable exercise kit for compactly storing and utilizing the portable exercise kit in methods of exercising, stretching, and combinations thereof.

In one aspect, the invention provides a portable exercise kit comprising a bench. Generally, the bench comprises a plurality of sections hingedly connected together, and each section of the plurality of sections comprises a frame portion with a plurality of cross members rigidly connected to the frame portions. A plurality of legs is also hingedly connected the sections. The bench also includes a plurality of eyelets that extend outwards from the perimeter of the bench, which may be used for attachment to one or more elastic members, for performance of exercises and stretches by an individual.

The kit also includes a padded member; the padded member is sized to cover a portion of the plurality of sections to increase comfort to the individual when using the kit. In various embodiments, the kit also includes an elastic member, the elastic member is reversibly attachable to the plurality of eyelets for the exercises and stretches.

In various embodiments, the legs of the plurality of legs are foldable to configure the legs to be compactly placed alongside the plurality of cross members. In addition, the sections of the plurality of sections are foldable to configure the sections to be compactly placed alongside one another. If the legs are folded inward, such that they are alongside the cross members, and the sections are also folded inward, such that they are adjacent one another, the bench occupies a relatively lesser volume and is configured for storage or transport. The sections are fully extendable to form a bench configuration, such that they are co-planar with one another, and are partially extendable to form a chair configuration. In this manner, the bench and/or the chair configuration of the bench may be utilized for exercises and/or stretches. Further, if the legs—or a selection thereof—are extended outward, such that they are perpendicular to the section to which they are hingedly connected, the legs may be used to contact a floor, a ground, or another lower surface for elevation of the bench therefrom to aid the individual using the kit.

Another object of the present invention is to provide a portable exercise kit that may be readily manufactured from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

DETAILED DESCRIPTION OF THE INVENTION

Figure 1:
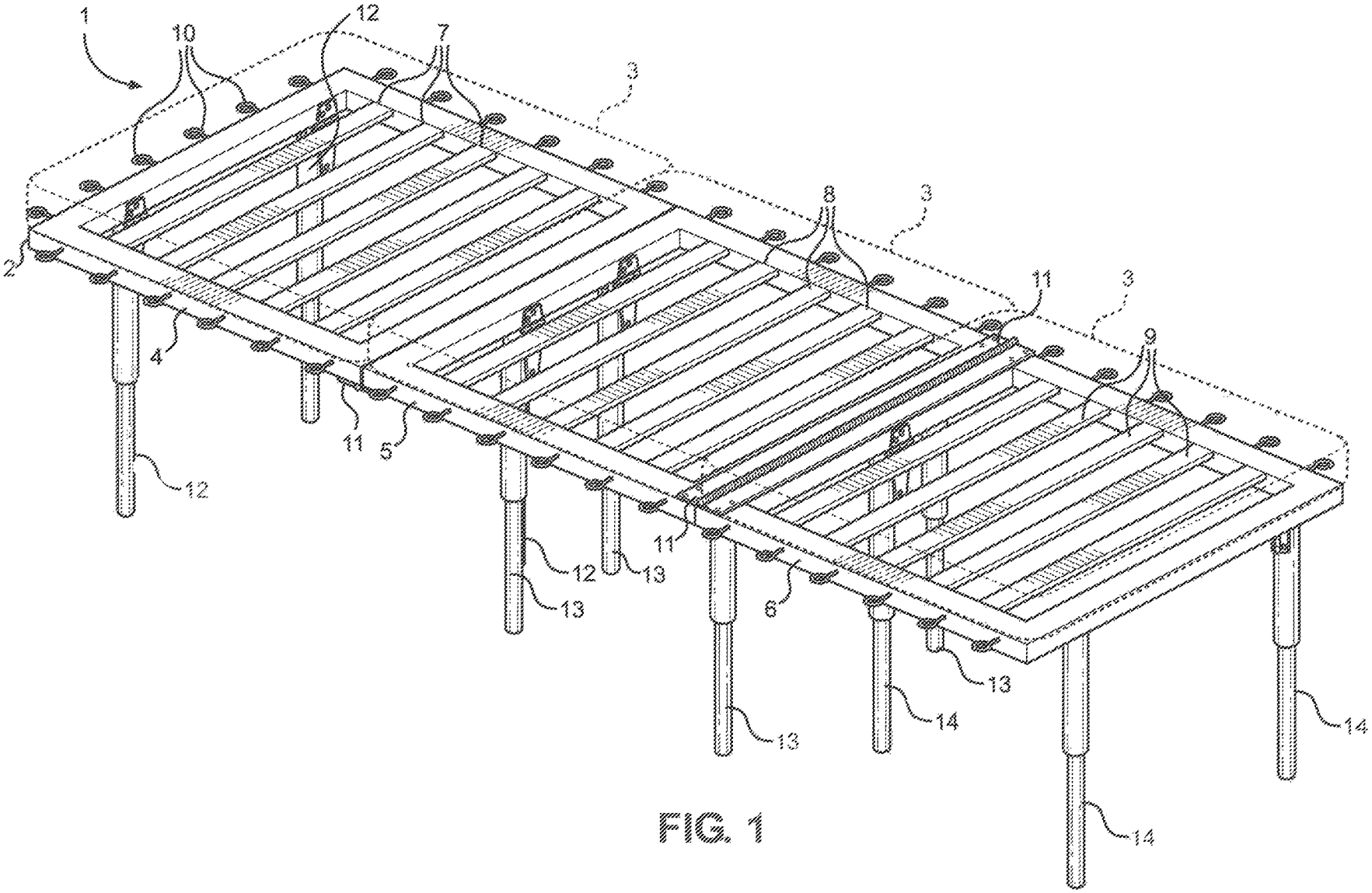
FIG. 1 depicts a side perspective view of an embodiment of the portable exercise kit, in a bench configuration.

Reference is made herein to the attached drawings. Like reference numerals are used throughout the drawings to depict like or similar elements of the invention. The figures are intended for representative purposes only and should not be considered limiting in any respect.

Figure 6:
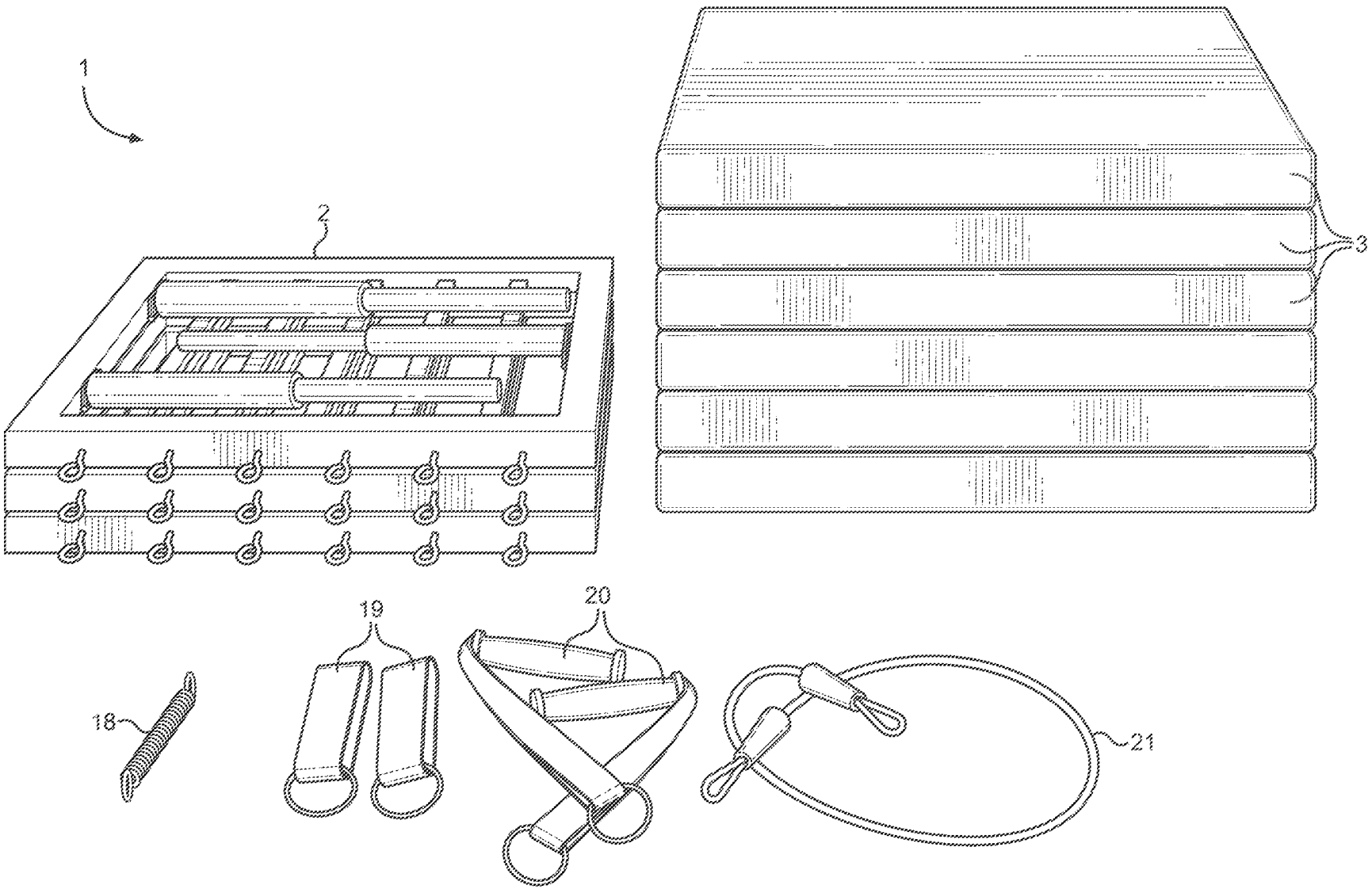
FIG. 6 depicts a perspective view of a set of components of the portable exercise kit, in a compact configuration for storage or transport of the kit.

Referring now to FIG. 6, there is depicted a perspective view of a set of components of an embodiment of the portable exercise kit, in a compact configuration for storage or transport of the kit. In various embodiments, a portable exercise kit 1 includes a bench 2, a padded member 3, and an elastic member. The bench 2 comprises a plurality of sections hingedly connected together, and each section of the plurality of sections comprises a frame portion with a plurality of cross members rigidly connected thereto, and a plurality of legs hingedly connected thereto. The bench 2 also includes a plurality of eyelets that extend therefrom, which may be used to engage one or more elastic members during exercise and/or training by an individual using the kit. The padded member 3 may include a plurality of padded members 3, as shown. In this manner, the padded member 3 may be sized to cover a portion of the plurality of sections of the bench 2, and multiple padded members 3 may be used to cover multiple portions of the plurality of sections, as would be understood by a person having ordinary skill in the art.

Generally, the term "elastic member", as used herein, refers to any suitable flexible and/or elastic structure that may be used by the individual to exercise and/or stretch. The elastic member may include one or more of a spring 18, a flexible loop 19, a rigid handle 20, and an elongated bungie cord 21. In one embodiment, the rigid handle 20 is removably securable to the elastic member. In addition, or in the alternative, the elastic member may be a combination and/or a plurality of any of these components or their structural or functional equivalents. In various embodiments, the components of the kit, which may include but may not necessarily be limited to the bench 2, the padded member 3, and the elastic member, are able to be in a relatively compact configuration for storage and/or transport, as shown, and may also be able to be in a relatively expanded configuration for use.

Referring now to FIG. 1, there is depicted a side perspective view of an embodiment of the portable exercise kit, in a bench configuration. Generally, as a component of the portable exercise kit 1, the bench 2 includes the plurality of sections. In the shown embodiment, the plurality of sections includes a first end section with a frame portion 4, a middle section with a frame portion 5, and a second end section with a frame portion 6. The frame portion 4 of the first end section includes a plurality of cross members 7, the frame portion 5 of the middle section includes a plurality of cross members 8, and the frame portion 6 of the second end section includes a plurality of cross members 9. The pluralities of cross members 7, 8, and 9 are rigidly affixed to the frame portions 4, 5, and 6, and the frame portions 4, 5, and 6 are hingedly connected to each other by hinges 11.

In the shown embodiment, the hinges 11 that connect the first end section to the middle section are positioned on a bottom side thereof, and the hinges 11 that connect the second end section to the middle section are positioned on a top side thereof. Further, in the shown embodiment, the hinges 11 run across an entire width of the bench 2. In other embodiments, smaller hinges 11 can be utilized that cover only a portion of the width of the bench 2. The first end section is configured to hingedly fold downward under the bottom side of the middle section, and the second end section is configured to hingedly fold upward over the top side of the middle section when folding and compacting the bench 2 for storage and/or transport. In such embodiments, if the second end section is folded the plurality of cross members 9 of the second end section is proximal to the plurality of cross members 8 of the middle section; similarly, if the first end section is folded the plurality of legs 12 of the first end section is proximal to the plurality of legs 13 of the middle section.

Figure 2:
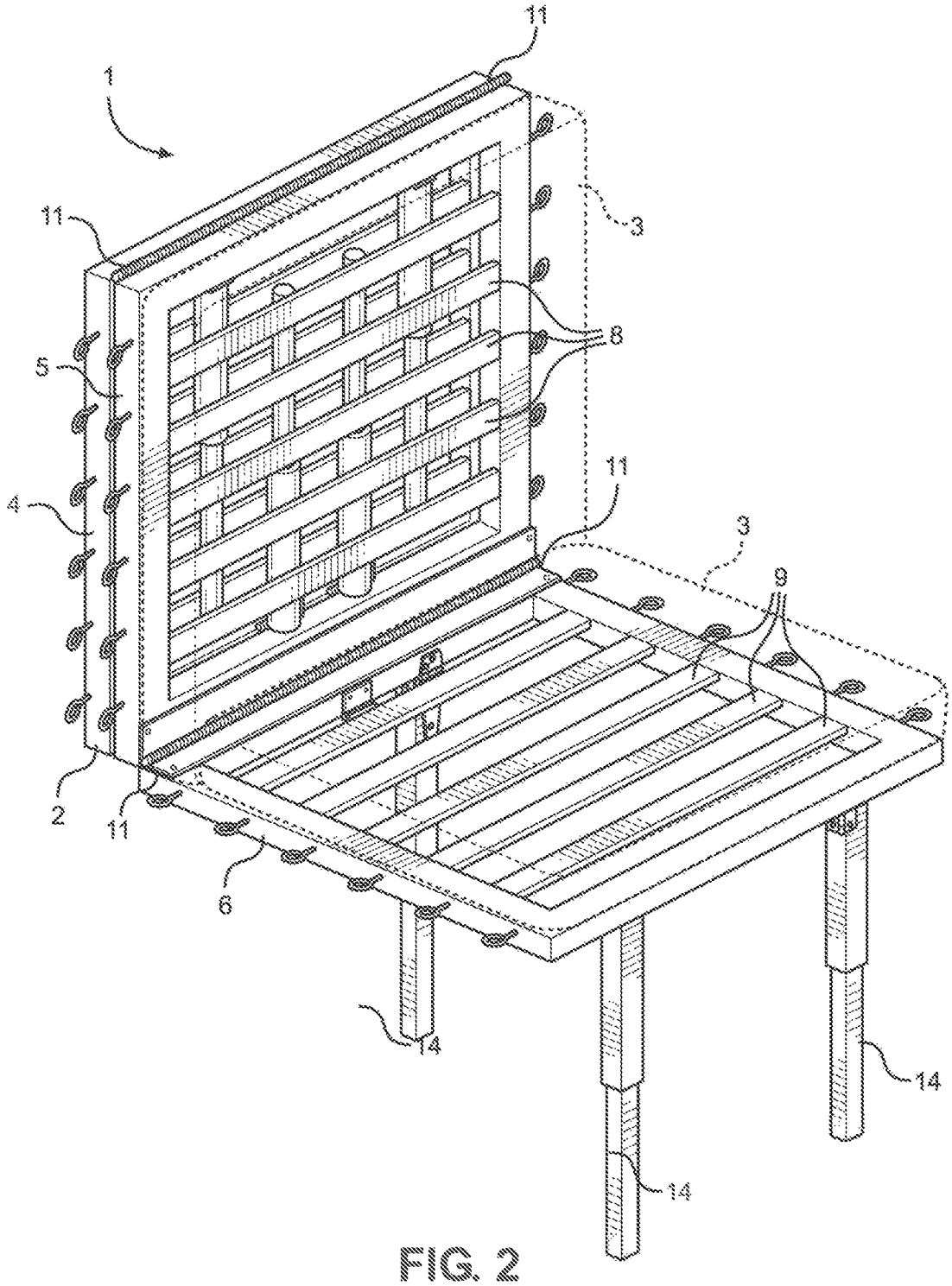
FIG. 2 depicts a side perspective view of the portable exercise kit, in a chair configuration.

In the shown embodiment, the legs of the pluralities of legs of the bench are both telescopic and foldable. In various embodiments, the legs comprise cylindrical cross-sections, as seen in FIG. 1, and square cross-sections, as seen in FIG. 2. The telescopic feature of the legs enables the individual to adjust a height of one or more sections of the plurality of sections of the bench 2, and to secure the height in place for use of the bench 2. A plurality of legs 12 of the first end section includes three legs 12, a plurality of legs 13 of the middle section includes four legs 13, and a plurality of legs 14 of the second end section includes three legs 14. In some embodiments, the number of legs of the bench 2 does not exceed ten, and in this manner, the bench 2 may be relatively lightweight compared to some alternate embodiments and may be easier to fold and compact. In such embodiments, the plurality of legs 12 consists of three legs, the plurality of legs 13 consists of four legs, and the plurality of legs 14 consists of three legs.

In the shown embodiment, the plurality of eyelets 10 includes eyelets that are affixed to the frame portions 4, 5, and 6 of each of the first end section, the middle section, and the second end section. The eyelets 10 extend laterally outward from the frame portions 4, 5, and 6. In the shown embodiment, a front surface of the second end section 6 is devoid of eyelets 10. In this manner, the eyelets 10 do not poke a portion of the individual using the bench 2, and comfort of the individual is increased or maximized during use of the bench 2. Similarly, the padded member 3 may increase or maximize comfort by cushioning the individual when seated on, lying on, or otherwise placing his or her body weight on the padded member 3. In like manner, the padded member 3 may elevate the individual above the eyelets 10, further ensuring the eyelets 10 do not decrease comfort by poking the individual during use.

Referring now to FIG. 2, there is depicted a side perspective view of the portable exercise kit, in a chair configuration. In various embodiments, any two sections of the plurality of sections of the bench 2 are configurable to be parallel or perpendicular to one another. In the shown configuration, the first end section (with the frame portion 4) is parallel (but not co-planar) with the middle section (with the frame portion 5), and the second end section (with the frame portion 6) is perpendicular with each of the first end section and the middle section. The plurality of legs 14 of the second end section are in an unfolded and extended configuration to engage a surface underneath the bench 2. In the chair configuration, eyelets 10 of the frame portion 6 may be used to reversibly attach one or more elastic members thereto, and in addition or in the alternative, the elastic member(s) may be reversibly attached to eyelets 10 of the frame portion 4, the frame portion 5, or a combination thereof. The padded member 3 includes a backrest padded member 3, which is placed over the frame portion 5 and the plurality of cross members 8 of the middle section, and a seat padded member 3, which is placed over the frame portion 6 and the plurality of cross members 9 of the second end section. In the chair configuration, the hinges 11 that connect the frame portion 4 to the frame portion 5 are fully compressed, and the hinges 11 that connect the frame portion 5 to the frame portion 6 are partially compressed.

Figure 3:
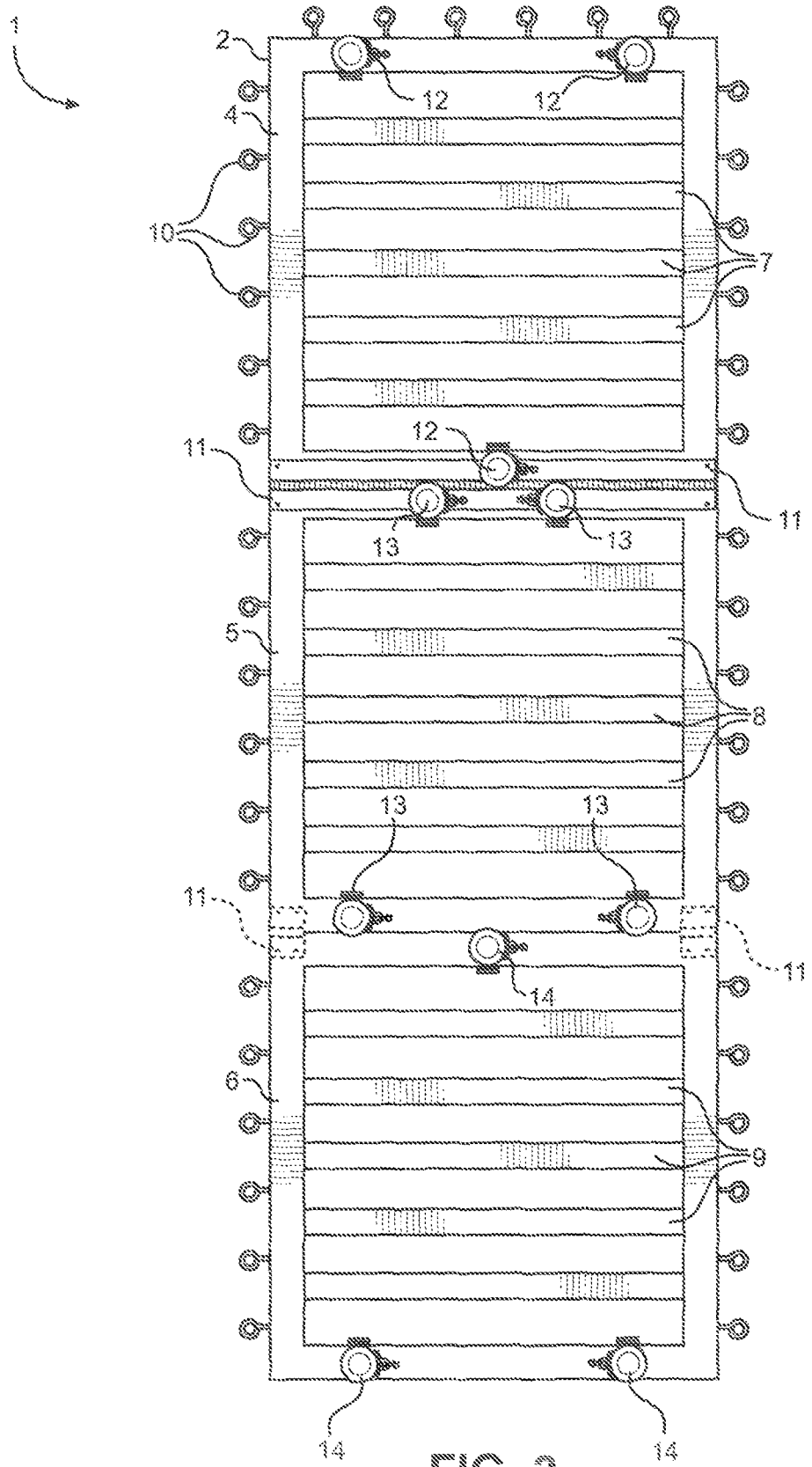
FIG. 3 depicts a bottom-up view of the portable exercise kit, in the bench configuration, with a plurality of legs unfolded such that it is perpendicular to a plurality of sections of the bench.
Figure 4:
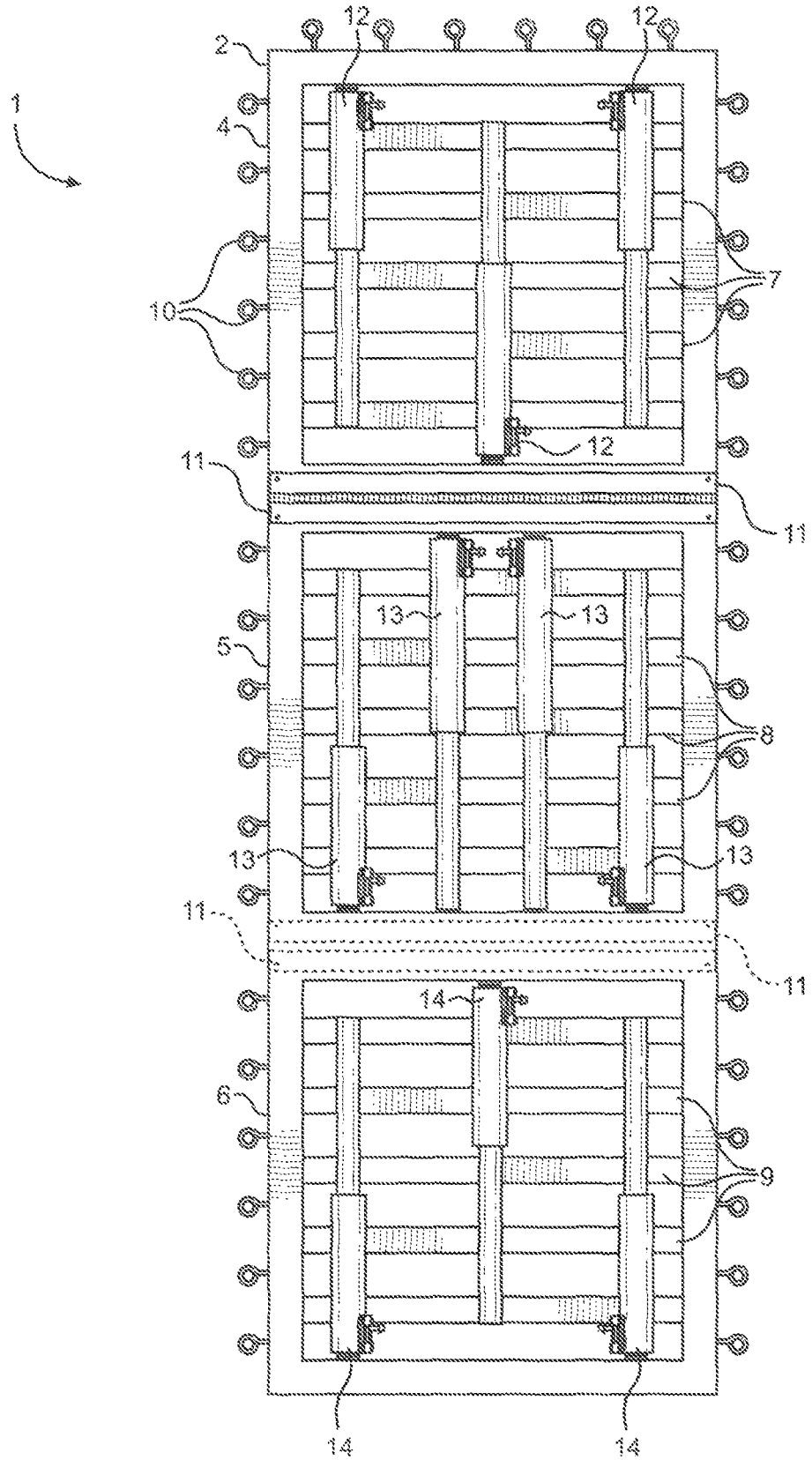
FIG. 4 depicts a bottom-up view of the portable exercise kit, in the bench configuration, with the plurality of legs folded such that it is parallel to the plurality of sections of the bench.

Referring now to FIGS. 3 and 4, there are depicted a bottom-up view of the bench, in the bench configuration, with a plurality of legs unfolded such that it is perpendicular to a plurality of sections of the bench (FIG. 3), and a bottom-up view of the bench, in the bench configuration, with the plurality of legs folded such that it is parallel to the plurality of sections of the bench (FIG. 4). The bench 2 of the kit 1 includes the first end section with the frame portion 4, the middle section with the frame portion 5, and the second end section with the frame portion 6, each hingedly connected to each other, as shown, by hinges 11. The frame portion 4 includes the plurality of cross members 7, the frame portion 5 includes the plurality of cross members 8, and the frame portion 6 includes the plurality of cross members 9. The pluralities of legs 12, 13, and 14 are extended from the frame portions 7, 8, and 9 toward the viewer, and in the shown bench configuration, the bench 2 may be configured for use with other components of the kit 1 (FIG. 3). To prepare the bench 2 for storage or transport, the pluralities of legs 12, 13, and 14 may be folded about leg hinges that hingedly connect the legs 12, 13, and 14 to the frame portions 4, 5, and 6. Further, in the shown embodiment, each of the legs 12, 13, and 14 include a sliding clasp which is received in a reciprocal hole in the corresponding frame portion 7, 8, and 9. One of ordinary skill in the art will understand how the sliding clasp can lock the legs 12, 13, and 14 into place and into a given configuration.

Figure 5A:
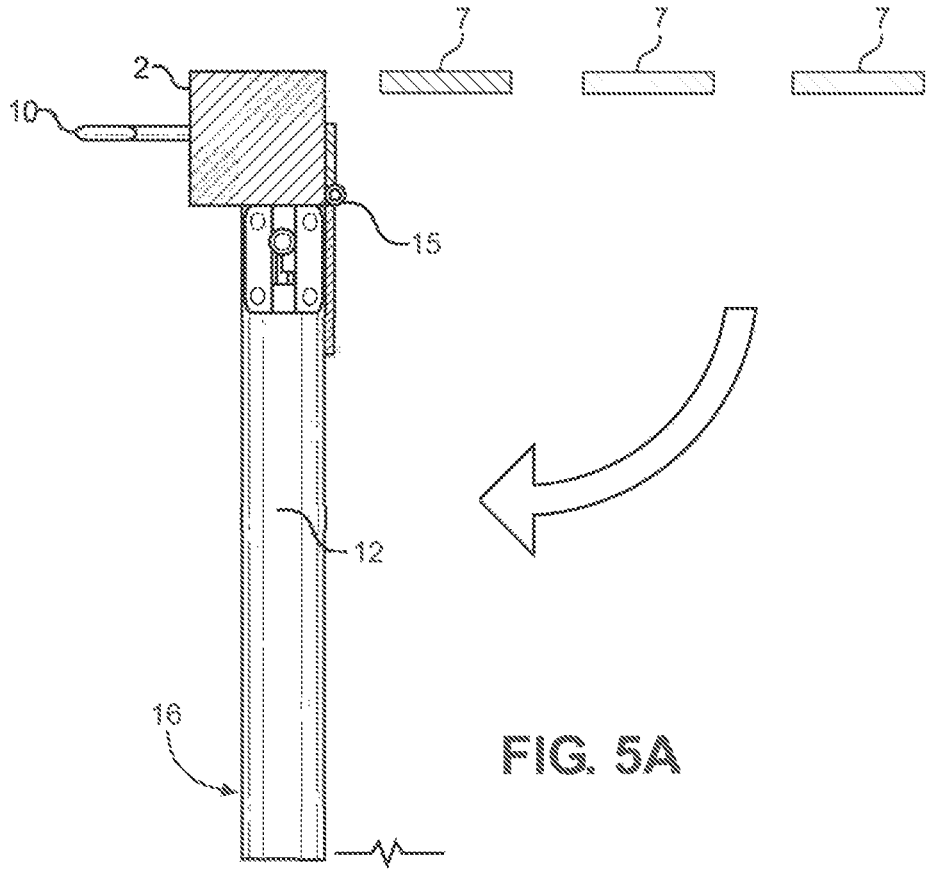
FIG. 5A depicts a cross sectional view of a leg of the plurality of legs, unfolded such that it is perpendicular to a plurality of cross members of a section of the plurality of sections.
Figure 5B:
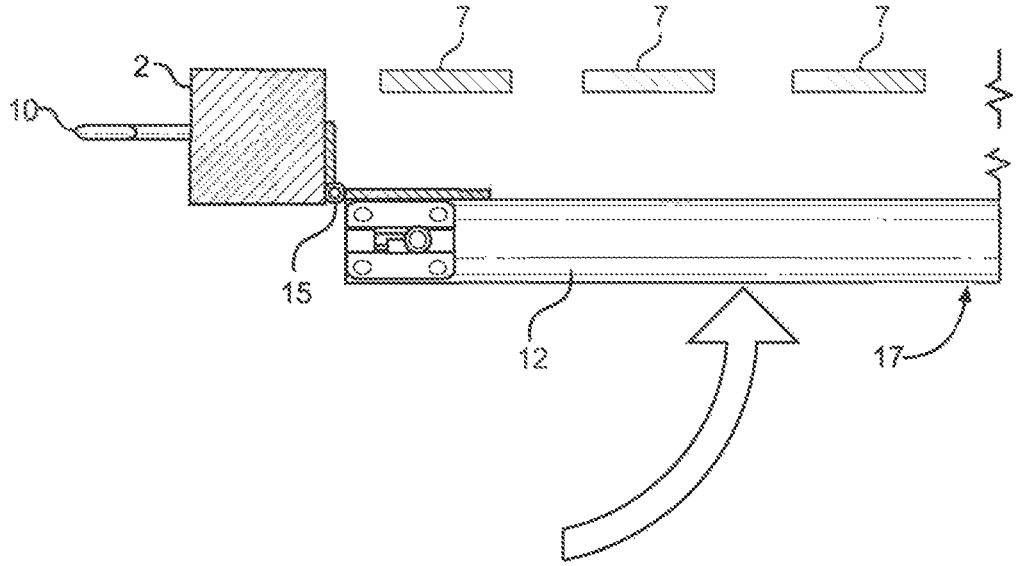
FIG. 5B depicts a cross sectional view of the leg of the plurality of legs, folded such that it is parallel to the plurality of cross members of the section of the plurality of sections.

Referring now to FIGS. 5A and 5B, there are depicted a cross sectional view of a leg of the plurality of legs, unfolded such that it is perpendicular to a plurality of cross members of a section of the plurality of sections (FIG. 5A), and a cross sectional view of the leg of the plurality of legs, folded such that it is parallel to the plurality of cross members of the section of the plurality of sections (FIG. 5B). In the shown embodiment, the eyelet 10 is affixed to the bench 2 (i.e., at an outer surface of the frame portion of the first section). The leg 12 is hingedly affixed to an inner surface of the frame portion of the first section. The plurality of cross members 7 is positioned such that an upper surface thereof is even with an upper surface of the frame portion. Generally, the configuration of the cross members 7 relative to the frame portion of the first section of the bench 2 is such that a space is formed within the frame portion and adjacent to the plurality of cross members 7. If each leg 12 of the plurality of legs is folded into the space in a compact configuration 17 (FIG. 5B), the leg 12 is flush with the plurality of cross members 7 and does not extend past the frame portion. If each leg 12 of the plurality of legs is extended out from the space in an expanded configuration 16 (FIG. 5A), the leg 12 is perpendicular to the plurality of cross members 7 and extends past the frame portion. This design, which configures the legs to fold into the spaces of the frame portions and the cross sections, is shown for a single leg 12 of the first end section; in preferred embodiments, the legs of the middle section and the second end section are designed likewise. In this manner, the legs are easily folded and compacted into the frame portions for storage or transport of the bench 2.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the present invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

I claim:

1. A portable exercise kit, comprising:

a bench, wherein the bench comprises a plurality of sections hingedly connected together;

wherein the plurality of sections includes a first end section, a middle section, and a second end section;

each section of the plurality of sections further comprises a frame portion with a plurality of cross members rigidly connected thereto and a plurality of legs hingedly connected thereto;

wherein the plurality of legs of the first end section comprises three legs, the plurality of legs of the middle section comprises four legs, and the plurality of legs of the second end section comprises three legs;

a plurality of eyelets extending from a perimeter of the bench;

a padded member sized to cover a portion of the plurality of sections; and an elastic member, wherein the elastic member is reversibly attachable to eyelets of the plurality of eyelets.

2. The portable exercise kit of claim 1, wherein the second end section is configured to hingedly fold upward over a top side of the middle section, and the first end section is configured to hingedly fold downward under a bottom side of the middle section.

3. The portable exercise kit of claim 2, wherein the second end section is configured to be folded such that the plurality of cross members of the second end section is proximal to the plurality of cross members of the middle section.

4. The portable exercise kit of claim 3, wherein the first end section is configured to be folded such that the plurality of leg of the first end section is proximal to the plurality of legs of the middle section.

5. The portable exercise kit of claim 1, wherein eyelets of the plurality of eyelets are connected to the frame portion of each of the first end section, the middle section, and the second end section.

6. The portable exercise kit of claim 5, wherein eyelets of the plurality of eyelets extend laterally outward from the frame portion of each of the first end section, the middle section, and the second end section.

7. The portable exercise kit of claim 1, wherein each leg of each plurality of legs is foldable into a space within the frame portion and adjacent to the plurality of cross members.

8. The portable exercise kit of claim 7, wherein each leg of each plurality of legs is folded into the space, each leg is flush with the plurality of cross members and does not extend past the frame portion.

9. The portable exercise kit of claim 1, wherein any two sections of the plurality of sections of the bench are configurable to be parallel to one another.

10. The portable exercise kit of claim 9, wherein the bench is configured to be in the bench configuration, the second end section is co-planar with each of the middle section and the first end section.

11. The portable exercise kit of claim 1, wherein any two sections of the plurality of sections of the bench are configurable to be perpendicular to one another.

12. The portable exercise kit of claim 11, wherein the bench is configured to be in the chair configuration, such that the second end section is perpendicular to each of the middle section and the first end section.

13. The portable exercise kit of claim 1, wherein each leg of each plurality of legs is foldable and each section of the plurality of sections is foldable to provide a storage configuration.

14. The portable exercise kit of claim 1, further comprising a handle removably securable to the elastic member.

15. The portable exercise kit of claim 1, wherein each leg of each plurality of legs is telescopically adjustable.

16. The portable exercise kit of claim 1, wherein the padded member is a plurality of padded members, wherein each padded member of the plurality of padded members is sized to cover a portion of the plurality of sections.

17. The portable exercise kit of claim 1, wherein the bench is configurable into a bench configuration or a chair configuration.

* * * * *